US008863988B2

(12) United States Patent
Kang

(10) Patent No.: US 8,863,988 B2
(45) Date of Patent: Oct. 21, 2014

(54) COSMETIC CONTAINER HAVING RELEASE PREVENTION DEVICE

(71) Applicant: Hana Co., Ltd., Hwaseong-si (KR)

(72) Inventor: Sungil Kang, Seoul (KR)

( * ) Notice: Subject to any disclaimer, the term of this patent is extended or adjusted under 35 U.S.C. 154(b) by 26 days.

(21) Appl. No.: 13/752,810

(22) Filed: Jan. 29, 2013

(65) Prior Publication Data

US 2013/0200106 A1 Aug. 8, 2013

(30) Foreign Application Priority Data

Feb. 2, 2012 (KR) ..... 20-2012-0000804 U

(51) Int. Cl.

| | |
|---|---|
| ***B67B 1/00*** | (2006.01) |
| ***B65D 88/54*** | (2006.01) |
| ***B05B 11/00*** | (2006.01) |
| ***B65D 55/02*** | (2006.01) |

(52) U.S. Cl.

CPC ..... *B65D 55/02* (2013.01); *B05B 11/3023* (2013.01); *B05B 11/3047* (2013.01); *B05B 11/3059* (2013.01)

USPC ..... 222/153.13; 222/321.9; 222/384

(58) Field of Classification Search

CPC ..... B05B 11/3059; B05B 11/306; B05B 11/3097

USPC ..... 222/153.01, 153.04, 153.09, 153.13, 222/321.1, 321.3, 321.7, 321.9, 384

See application file for complete search history.

(56) References Cited

U.S. PATENT DOCUMENTS

| | | | | | |
|---|---|---|---|---|---|
| 4,065,036 | A | * | 12/1977 | Kirk, Jr. | 222/153.13 |
| 4,162,746 | A | * | 7/1979 | Anderson et al. | 222/153.13 |
| 4,340,158 | A | * | 7/1982 | Ford et al. | 222/153.13 |
| 4,369,899 | A | * | 1/1983 | Magers et al. | 222/153.13 |
| 4,479,589 | A | * | 10/1984 | Ford | 222/153.13 |
| 4,991,746 | A | * | 2/1991 | Schultz | 222/153.13 |
| 5,335,830 | A | * | 8/1994 | Cater | 222/153.13 |
| 5,615,806 | A | * | 4/1997 | Grothoff | 222/153.13 |
| 5,826,756 | A | * | 10/1998 | Foster | 222/321.3 |
| 5,899,363 | A | * | 5/1999 | Bliss et al. | 222/153.02 |
| 6,065,647 | A | * | 5/2000 | Bliss et al. | 222/153.02 |

FOREIGN PATENT DOCUMENTS

| | | | | |
|---|---|---|---|---|
| GB | 2124711 | A * | 2/1984 | F04B 1/06 |
| KR | 2004397610000 | | 4/2008 | |

* cited by examiner

*Primary Examiner* — Patrick M Buechner

(74) *Attorney, Agent, or Firm* — East West Law Group; Heedong Chae

(57) ABSTRACT

The cosmetic container having a release prevention device in which a vertical bar type stopper is applied to a release-prevention and locking device and a vertical panel type protrusion having teeth is installed to implement a stopper function, a release-prevention function, and a remaining liquid absorbing function. The cosmetic container includes a connector tube stuck to the inner wall of the cylinder, a hollow piston coupled with the lower end of the connector tube to support the connector tube, a release-preventing and locking device having a lower end to be inserted into the cylinder and allowing a screw-coupling of an upper outer side of the cosmetic container, and a push button coupled with the top of the release-preventing and locking device and pumping the hollow piston while up-and-down movements to pump the content in the cosmetic container out through an ejection hole.

6 Claims, 9 Drawing Sheets

COSMETIC CONTAINER HAVING RELEASE PREVENTION DEVICE

BACKGROUND OF THE INVENTION

1. Field of the Invention

The present invention relates to a cosmetic container having a release prevention device, and more particularly, to a cosmetic container having a release prevention device, in which a vertical bar type stopper, having a left vertical surface and a right slope, is applied to a release-prevention and locking device and a vertical panel type protrusion having teeth is additionally installed to implement a stopper function, a release-prevention function, and a remaining liquid absorbing function.

2. Description of the Related Art

In general, a liquid container containing liquid cosmetics, paste cosmetics, etc., includes a pump assembly discharging every preset dose to use under an air pressure.

The pump assembly according to the related art, as illustrated in FIG. 1, includes a pumping unit 10 coupled with an entrance (not shown) of the liquid container and having a pressure chamber 11*a* for temporally accommodating pumped liquid, and a button unit 20 for applying a pressure to the pressure chamber 11*a* of the pumping unit 10 and having a discharging hole 21 for discharging the pumped liquid to the outside.

The pumping unit 10 includes a cylinder 11 coaxially provided at the internal center of a cap housing 12 and having a pressure chamber 11*a* formed therein, a coil spring 13 installed in the pressure chamber 11*a* of the cylinder 11, a hollow piston 14 elastically supported at the top of the coil spring 13 and having a through-hole 14*a* formed in a side thereof, a cylinder cap 15 through which the hollow piston 14 penetrates with sliding therethrough and closing the top of the hollow piston 14, a connector tube 16 connecting an ejecting hole 21 of the button unit 20 to the hollow piston 14, and a ball valve (steel ball) 17 disposed in the bottom end 11*b* of the cylinder 11.

Then, when a user presses the button unit 20, the hollow piston 14 descends along the cylinder cap 15 against the elastic force of the coil spring 13 so that liquid filled in the pressure chamber 11*a* of the cylinder passes through the through-hole 14*a*→a hollow portion of the hollow piston 14→the connector tube 16→the ejecting hole 21 to be ejected out. In this case, the ball valve 17 brings in contact with a locking step 11*b* by the press of the descending liquid in the cylinder 11 to interrupt the communication between the pressure chamber 11*a* and the interior of the liquid container.

When a user releases the button unit 20, the hollow piston 14 ascends along the cylinder cap 15 by the elastic supporting force of the coil spring 13 and the through-hole 14*a* is closed so that the ejection of the liquid is stopped and the pressure chamber 11*a* of the cylinder 11 is vacuumed. Thus, the liquid contained in the liquid container fills up the pressure chamber 11*a* while lifting the ball valve 17 up. These repetition pressings of the button unit 20 bring ejection of a preset amount of liquid in the container.

However, the pump assembly of a liquid container according to the related art has disadvantage that content contained in the liquid container may leak out during distribution because of absence of a separate device for preventing the button unit 20 from being pressed.

That is, the button unit 20 of the pump assembly may be pressed by an external force not an artificial force during the distribution. In this case, the button unit 20 works without resistance and leaks liquid.

In order to overcome these problems, a locking device has been developed, according to Korean Utility Model Application No. 20-0439761, a locking device 190 is intended for a user to restrict descending of a push button 130 artificially and includes an internal locking step 191 protruding from an inner wall of the push button 130 and a locking member 192 disposed between a cap unit 110 and the push button 130 while wrapping a cylindrical guide 113 and having an insertion recess 193 formed in the longitudinal direction such that the inner locking step 191 may be inserted.

The inner locking step 191 protruded from the inner wall of the push button 130 and is depicted as extending from the top to the bottom in embodiments of the present invention. However, even when the inner locking step 191 is formed on the lower side of the inner wall, the aim of the present invention may be achieved.

The locking member 192 has a cylindrical shape with an opened top and an opened bottom to be disposed between the cap unit 110 and the push bottom 130, such that the locking member 192 is accommodated in the push button 130 when the push button 130 descends. That is, the push button 130 is allowed to descend when the locking member 192 is rotated to align the inner locking step 191 with the insertion recess 193, and the inner locking step 191 is locked by the upper side of the locking member 192 to restrict the descending of the push button 130 when the inner locking step 191 is not aligned with the insertion recess 193.

Moreover, a plurality of locking protrusions 194 is disposed on the lower outer wall of the locking member 192 by a regular interval to be press-fitted in the lower side of the push button 130 when the push button 130 descends as lower as possible. Thus, when the push button 130 is pressed as much as possible when the inner locking step 191 is aligned with the insertion recess 193, the locking member 192 is press-coupled in the push button 130 by the plurality of locking protrusions 194 so that the locking member 192 moves with the push button 130 integrally unless the locking member 192 is pulled out from the push button 130.

In addition, a stepped stopper 195 protrudes from the top of the locking member 192 to come in contact with a side of the inner locking step 191 by rotating the locking member 192 by a degree by a user. The stopper 195 is designed for easy determination of alignment between the inner locking step 191 and the insertion recess 193 and has a semi-circular shape protruding from the uppermost end of the insertion recess 193 along the top of the locking member 192.

However, the above-described locking device has very complicated drawbacks.

That is, a device for locking a cosmetic container according to the related art uses total four parts such as the push button 130, the locking device 190, and the cap units 111 and 115 so that price of products rises and operations are complicated.

As well, according to the related art, even if a container coupler were added to the locking device while reducing the number of parts and the push button is configured therein, the locking device is released and separated from the cosmetic container while the rotation of the push button.

BRIEF SUMMARY OF THE INVENTION

The present invention provides a cosmetic container for performing a locking function of a push button by using two major parts and preventing releasing of the push button while performance of a locking function of the push button.

The present invention also provides a cosmetic container having a suction function of remaining cosmetics such that manufacturing cost may be minimized with minimum number of parts and for preventing a push button from being released and a tiny quantity of liquid from remaining in an exit of the push button such that the liquid cosmetics are prevented from being contaminated.

The object is achieved by a cosmetic container having a release-preventing device including: a cylinder formed with a pressure chamber where content in a cosmetic container is suctioned and temporally accommodated; a connector tube stuck to the inner wall of the cylinder; a hollow piston coupled with the lower end of the connector tube to support the connector tube; a release-preventing and locking device having a lower end to be inserted into the cylinder and allowing a screw-coupling of an upper outer side of the cosmetic container; and a push button coupled with the top of the release-preventing and locking device and pumping the hollow piston while up-and-down movements to pump the content in the cosmetic container out through an ejection hole, including an inner guide body and an outer guide body for the coupling with the release-preventing and locking device, and a plurality of blades formed on a body the outer circumference of the inner guide body to determine up-and-down movements of the inner guide body; wherein the release-preventing and locking device includes: a first cylindrical guide unit allowing the inner guide body of the push button to slide; a second cylindrical guide unit allowing the outer guide body of the push button to slide; a semi-circular stopper inserted into the inner circumference of the first cylindrical guide unit to lock the blades and to block descending of the push button to prevent the liquid in the cosmetic container from being pumped out; a push button movement space formed on the first cylindrical guide unit and allowing the up-and-down movements of the blades of the push button with the parts except for the semi-circular stopper such that pumping caused by the descending of the push button is enabled; and a vertical bar type stopper installed at the top side end of the stopper and having a left vertical side and a right slope to block the clockwise rotation of the push button and to allow the counterclockwise rotation of the push button.

According to the cosmetic container of the present invention, the first cylindrical guide unit includes a first vertical panel type protrusion installed at a side of the push button movement space and temporally blocking the horizontal rotation of the push button when the push button rotated to be positioned at a pumping position.

Moreover, the first vertical panel type protrusion has both oblique sides.

The first cylindrical guide unit includes a second vertical panel type protrusion installed on the semi-circular stopper, positioned at the left side of the vertical bar type stopper, and temporally blocking the horizontal rotation of the blades of the push button when the push button rotates clockwise and is positioned at a position where pumping is not carried out.

Moreover, the second vertical panel protrusion has both oblique sides.

The second vertical panel type protrusion has a tooth shape with both swollen sides and a concave center such that the blades of the push button ride thereon and suctioning of the remaining liquid is enabled.

BRIEF DESCRIPTION OF THE DRAWING

The objects, features and advantages of the present invention will be more apparent from the following detailed description in conjunction with the accompanying drawings, in which.

DETAILED DESCRIPTION OF THE INVENTION

Hereinafter, exemplary embodiments of the present invention will be described in detail with reference to the accompanying drawings. The same reference symbols are used throughout the drawings to refer to the same or like parts. Detailed descriptions of well-known functions and structures incorporated herein may be omitted to avoid obscuring the subject matter of the present invention.

Accordingly, the meaning of specific terms or words used in the specification and the claims should not be limited to the literal or commonly employed sense, but should be construed in accordance with the spirit of the invention.

Figure 1:
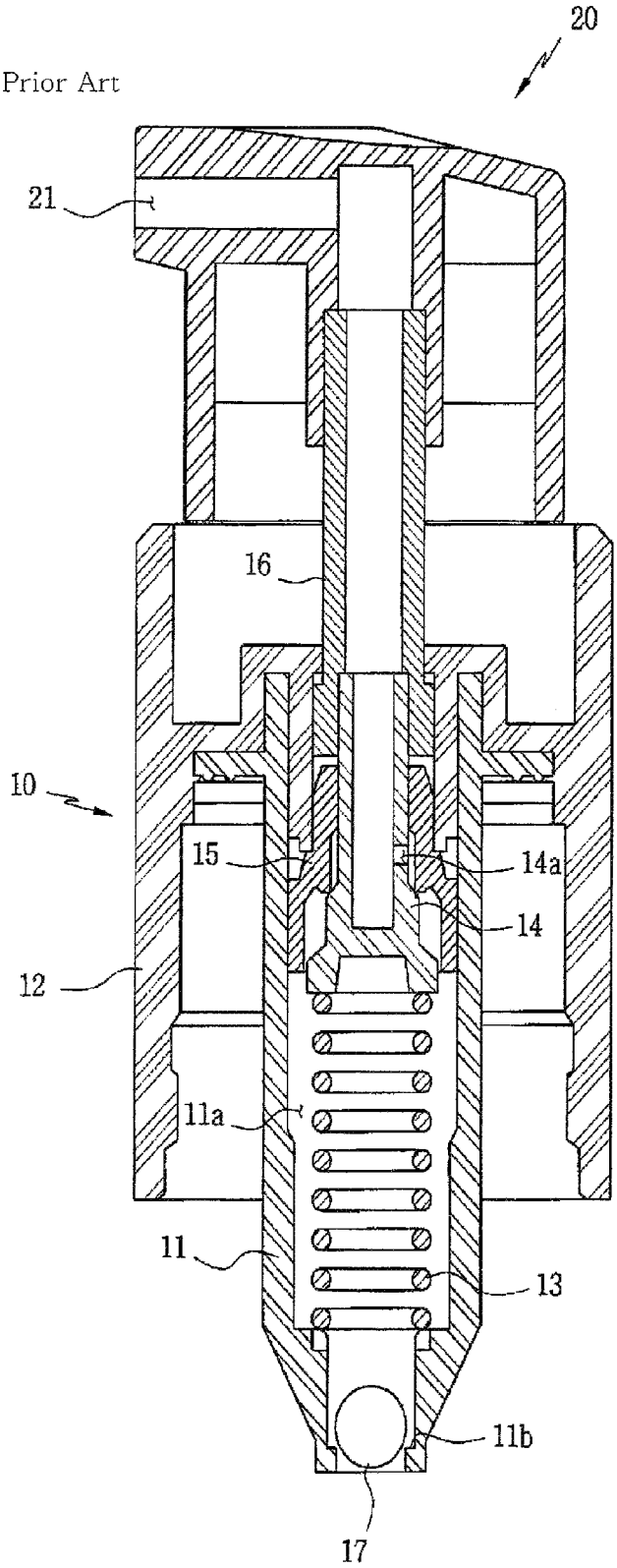
FIG. 1 Prior Art
FIG. 1 is a sectional view illustrating a cosmetic container according to a first embodiment of a related art.
Figure 2:
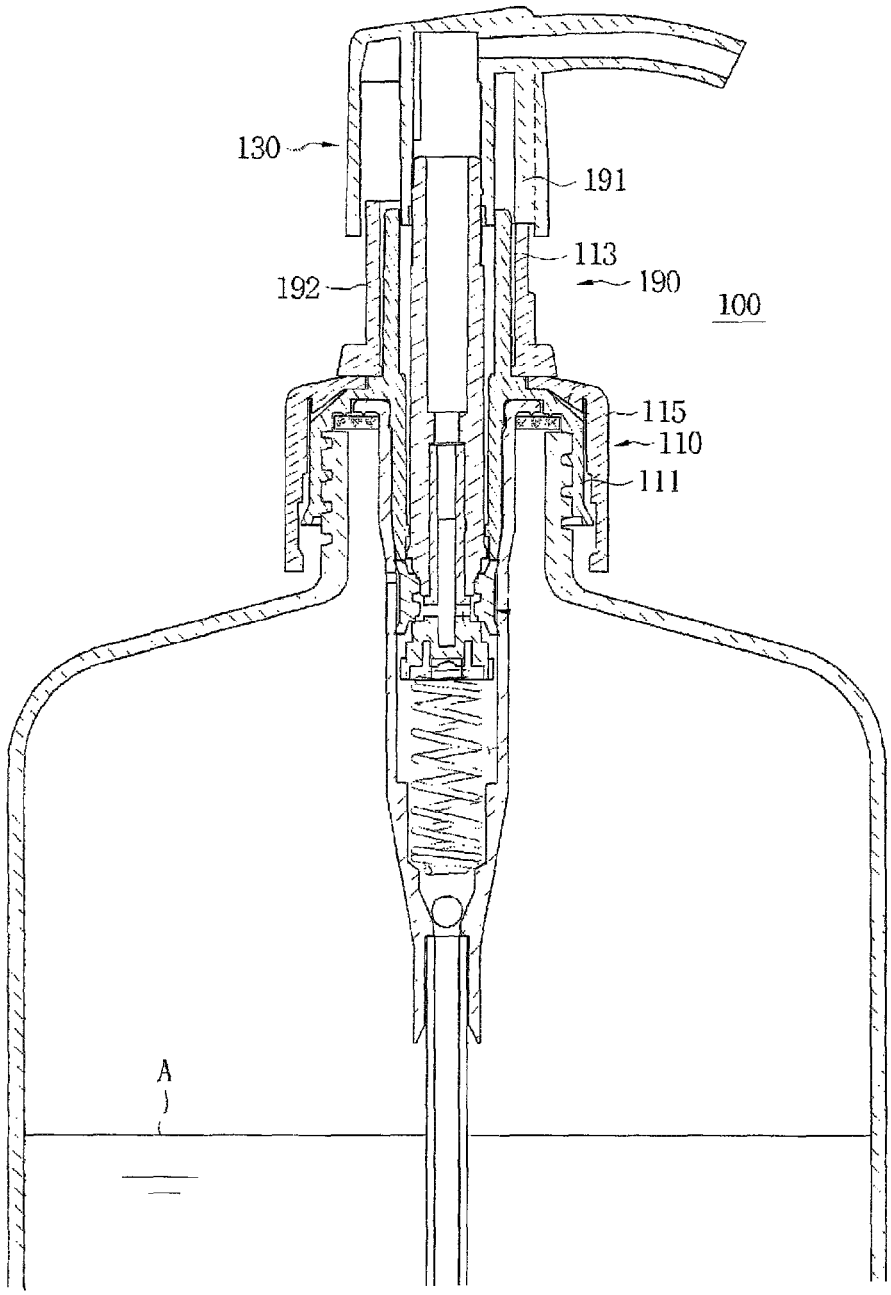
FIG. 2 Prior Art
FIG. 2 is a sectional view illustrating a cosmetic container according to a second embodiment of the related art.
Figure 3:
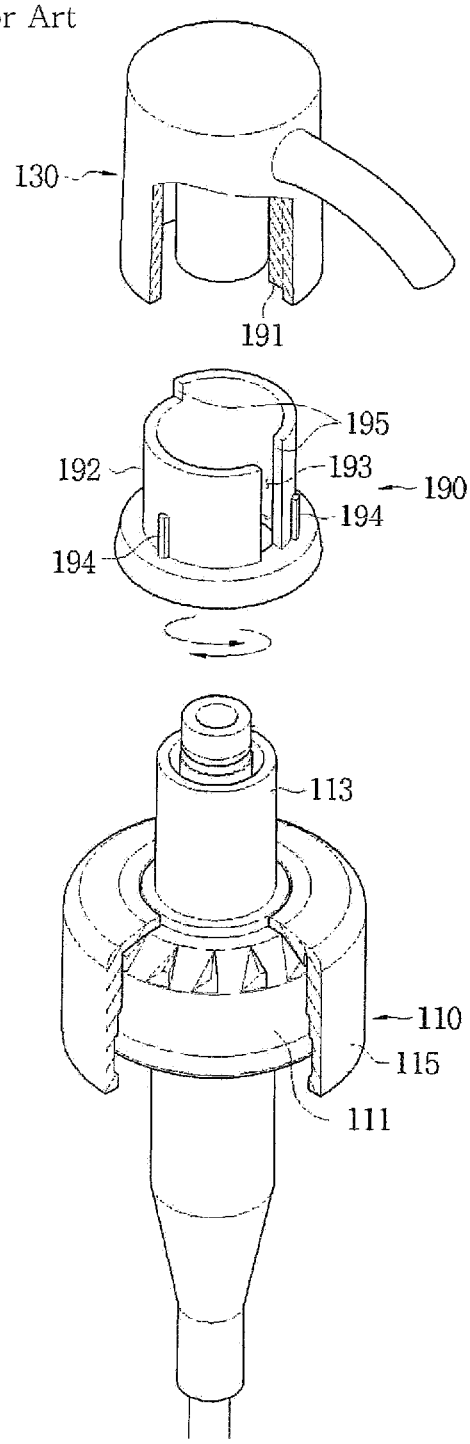
FIG. 3 Prior Art
FIG. 3 is an exploded perspective view of the cosmetic container as illustrated in FIG. 2.
Figure 4:
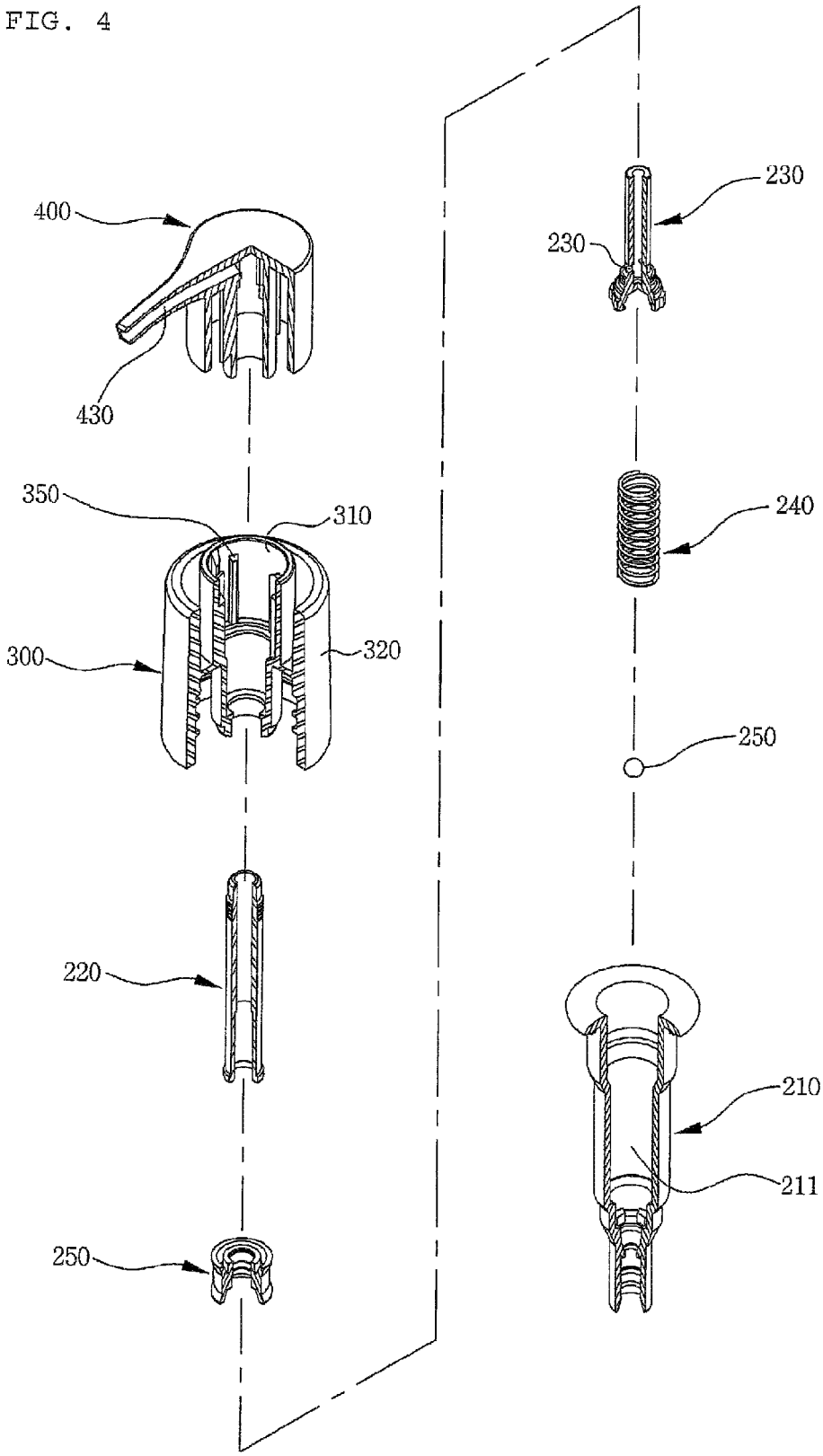
FIG. 4 is an exploded perspective view illustrating a cosmetic container according to an embodiment of the present invention.

FIG. 4 is an exploded perspective view illustrating a cosmetic container according to an embodiment of the present invention.

Figure 5:
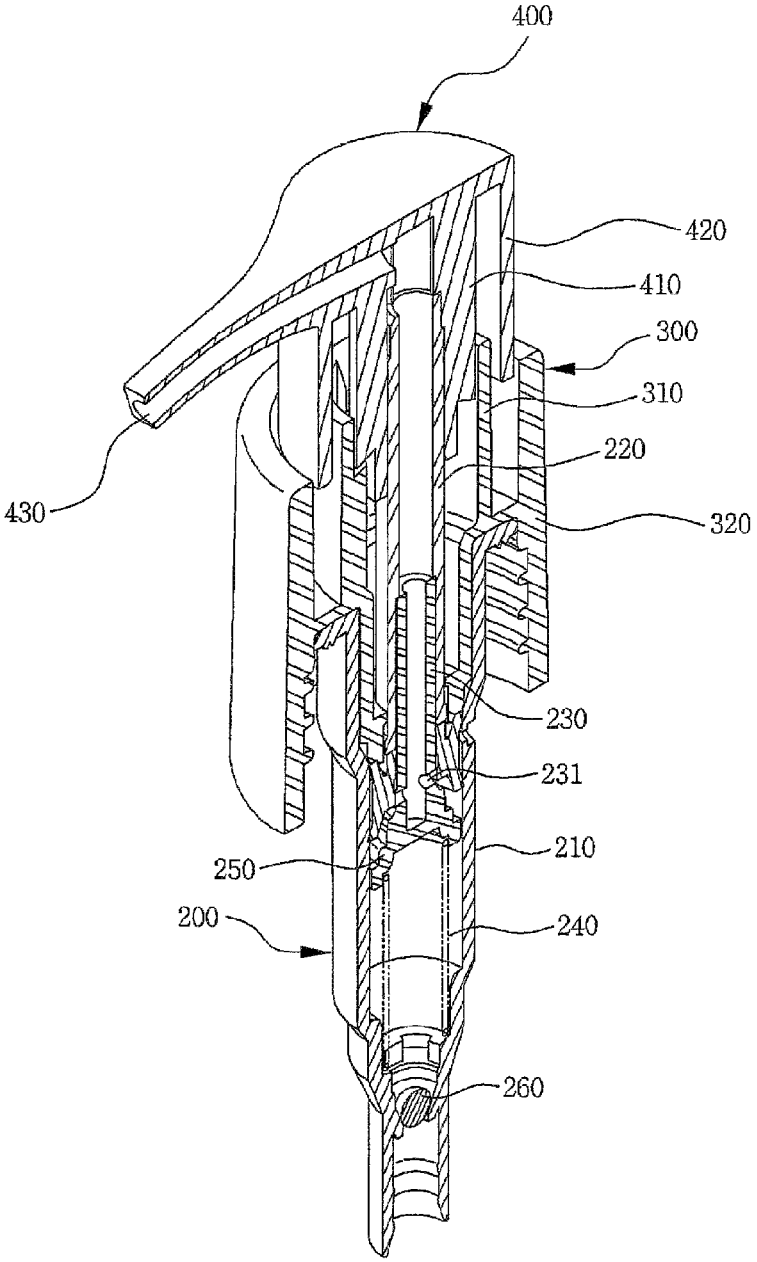
FIG. 5 is a sectional perspective view illustrating an assembly of the cosmetic container according to an embodiment of the present invention.

FIG. 5 is a sectional perspective view illustrating an assembly of the cosmetic container according to an embodiment of the present invention.

Figure 6:
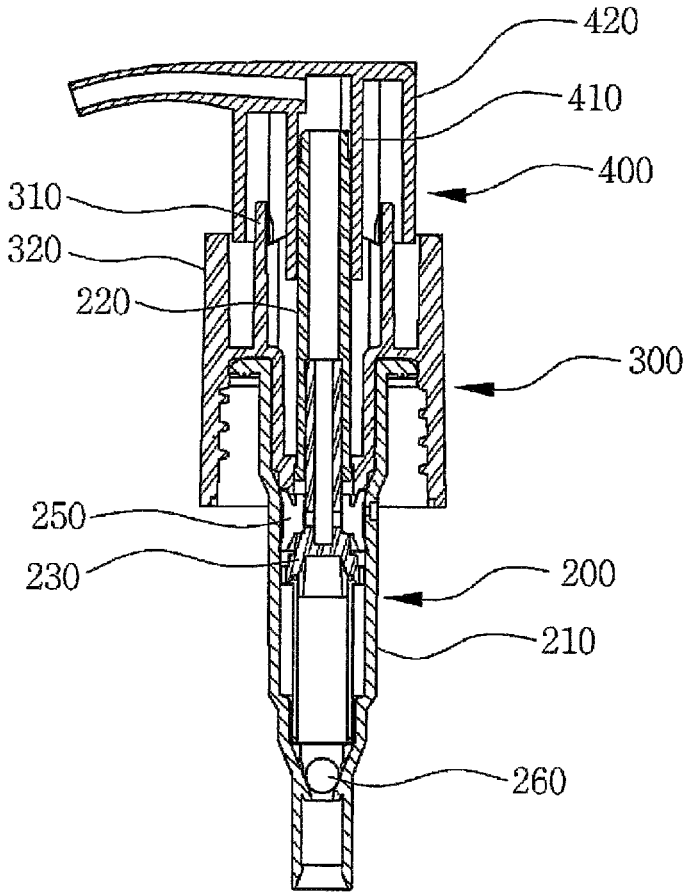
FIG. 6 is a sectional view illustrating the assembly of the cosmetic container according to an embodiment of the present invention.

FIG. 6 is a sectional view illustrating the assembly of the cosmetic container according to an embodiment of the present invention.

Figure 7:
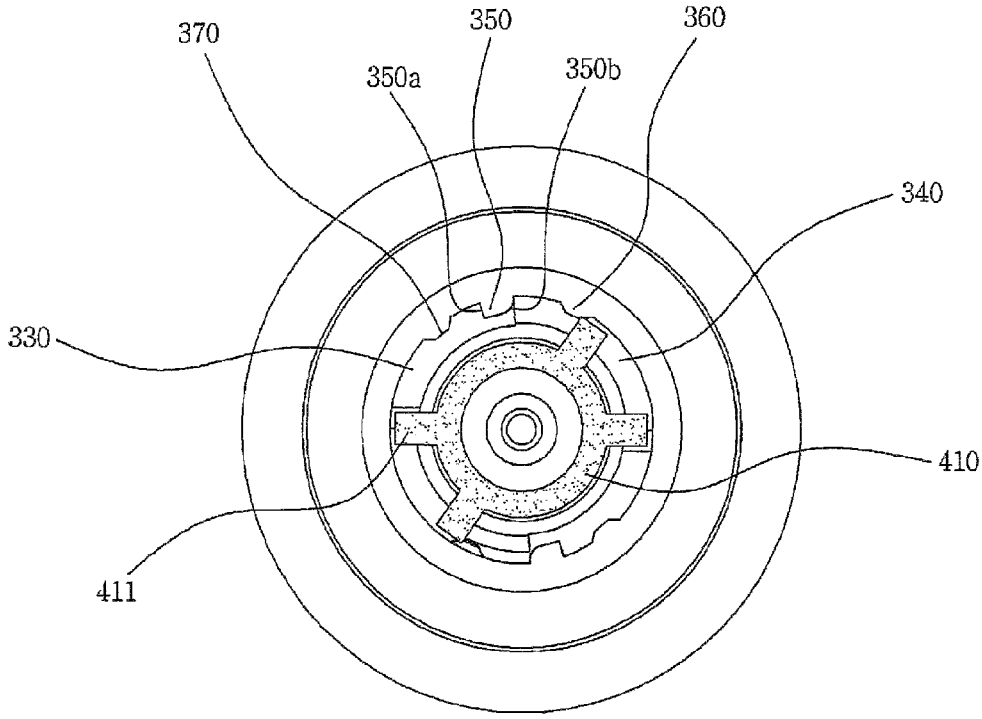
FIG. 7 is a horizontal section view illustrating a release-preventing and locking device according to an embodiment of the present invention.

FIG. 7 is a horizontal section view illustrating a release-preventing and locking device according to an embodiment of the present invention.

Figure 8:
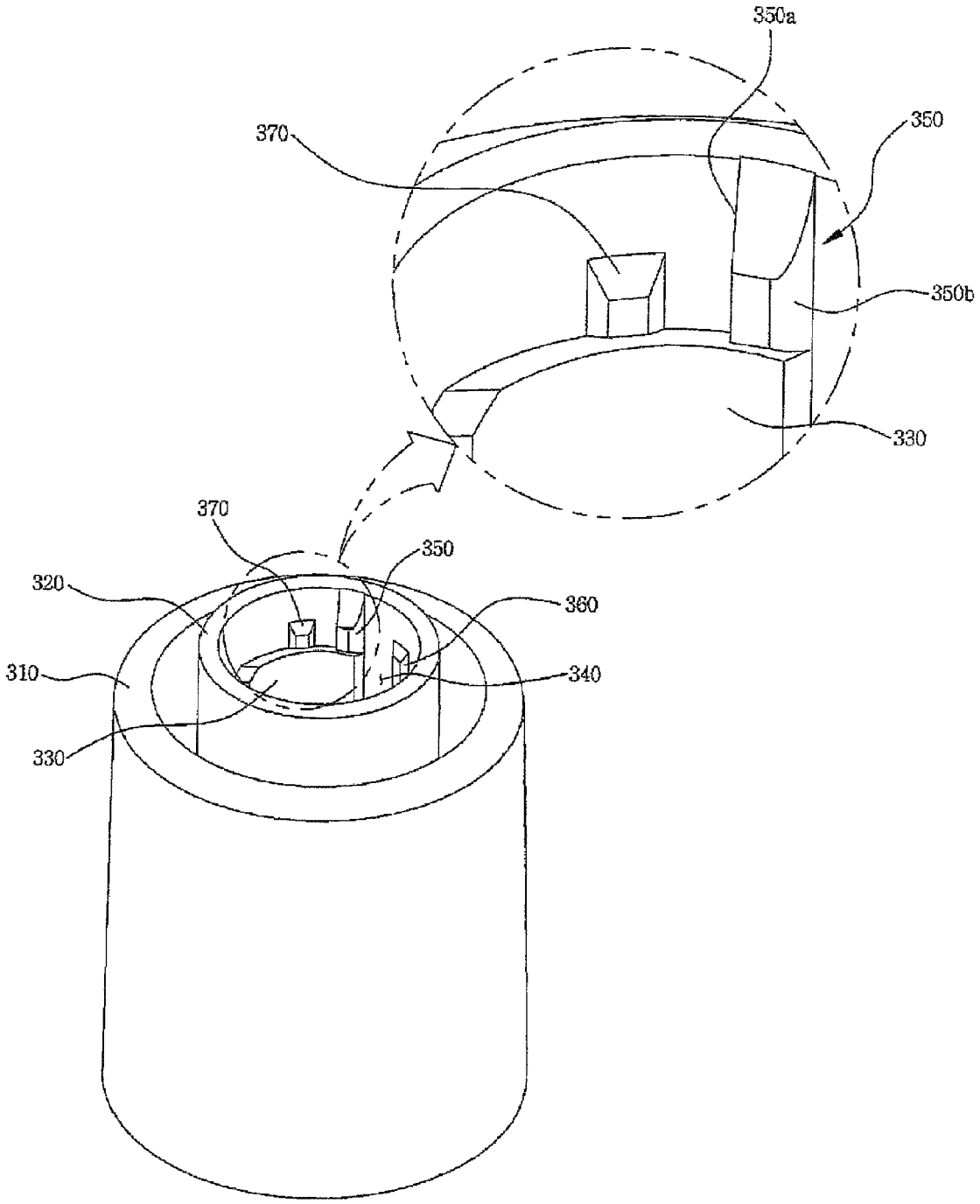
FIG. 8 is a partially-enlarge view of the release-preventing and locking device according to an embodiment of the present invention.

FIG. 8 is a partially-enlarge view of the release-preventing and locking device according to an embodiment of the present invention.

Figure 9:
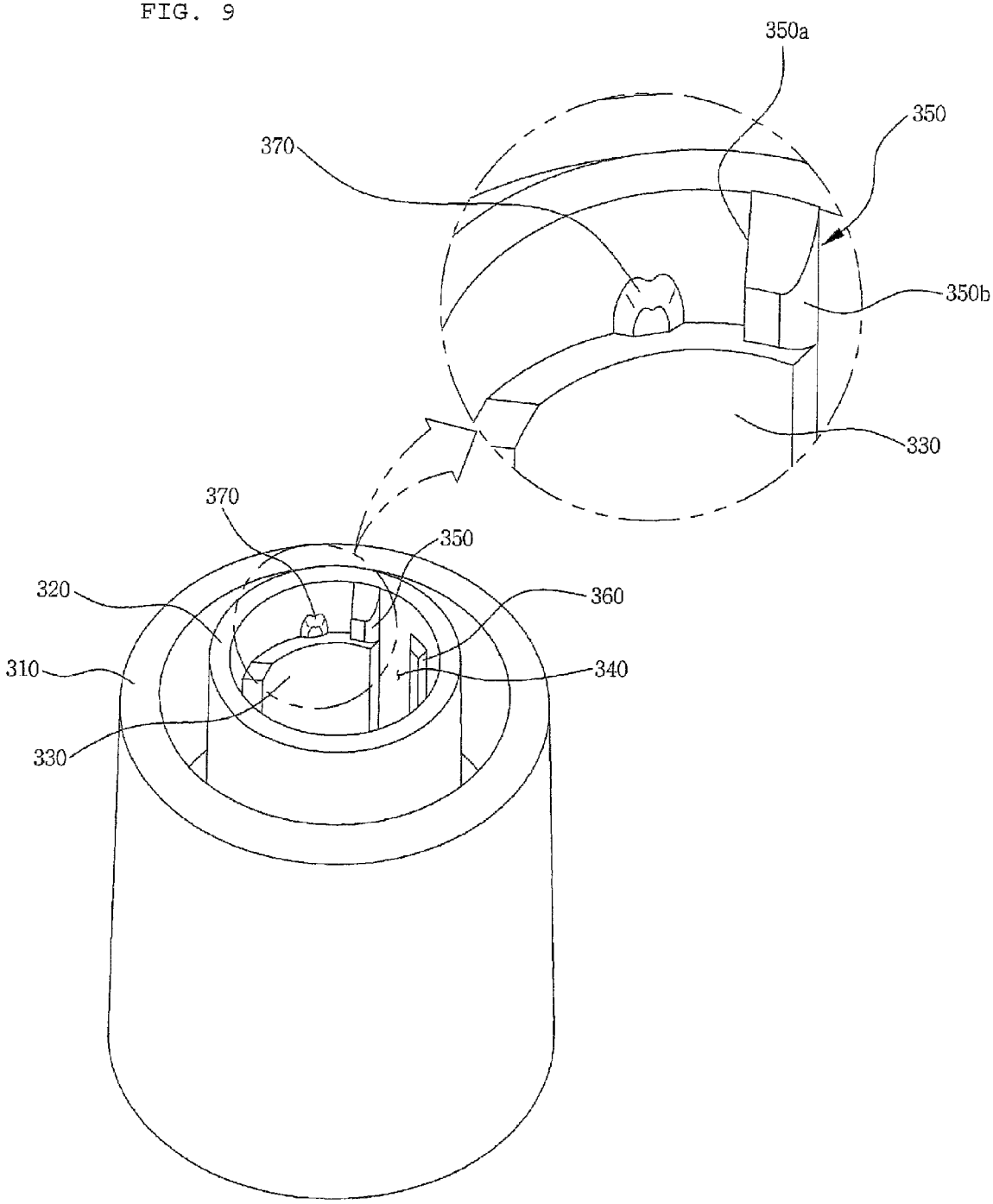
FIG. 9 is a perspective view illustrating an embodiment of the release-preventing and locking device according to an embodiment of the present invention.

FIG. 9 is a perspective view illustrating an embodiment of the release-preventing and locking device according to an embodiment of the present invention.

Elements of the cosmetic container according to an embodiment of the present invention will be described in detail as follows.

A cosmetic container according to an embodiment of the present invention includes basic elements such as a container housing 100 and a pumping unit 200 and additional elements such as a release-preventing and locking device 300 and a push button 400. The container housing 100 may have a cylindrical shape, an oval shape, or a polygonal shape with an internal space for accommodating liquid cosmetics therein, wherein the pumping unit 200 includes a well-known cylinder 210, a well-known connector tube 220, a hollow piston 230, an elastic spring 240, and a silicon cap 250.

That is, the pumping unit 200 includes the connector tube 220 sticking the inner wall of the cylinder 210 and lowering by pressing the push button 400 and the hollow piston 230 coupled with the lower end of the connector tube 220 to support the connector tube 220. Moreover, the hollow piston 230 has a communication hole 231 to be opened and closed by a hollow silicon cap 250. That is, when the connector tube 220 descends and the hollow piston 230 also descends, the hollow piston 230 further descend while pressing the elastic spring 240, and due to these operations, the content in a pressure chamber 211 is pressed and the hollow silicon cap 250 is elastically deformed and is lifted from the hollow piston 230. Thus, the content A in the pressure chamber 211 is discharged out by the hollow piston 220, the connector tube 230, and the push button 400.

Basic configuration and operations of the pumping unit are already known and therefore their description will be omitted.

The container housing 100 has an entrance coupled with the release-preventing and locking device 300 as a coupler device, which couples the pumping unit 200, and the push button 400 for transmitting a physical force pumping the content in the container from the outside is coupled with the upper side of the release-preventing and locking device 300.

That is, the release-preventing and locking device 300 is coupled with the cylinder 210 by which the lower side of the release-preventing and locking device 300 is inserted into the cylinder 210 and which is screw-coupled with the top outer side of the container to close the entrance of the container. The push button 400 is coupled with the top of the release-preventing and locking device 300, is designed to pump the hollow piston 230 with the up-and-down movement such that the content in the container is pumped and ejected out through an ejection hole 430, includes an inner guide body 410 and an outer guide body 420 for the coupling with the release-preventing and locking device 300, and a plurality of blades 411 formed on the outer circumference of the inner guide body 410 to determine the up-and-down movement.

The core element of the cosmetic container according to an embodiment of the present invention, that is, the release-preventing and locking device 300 includes a first cylindrical guide unit 310 for coupling the inner guide body 410 of the push button 400 to slide, a second cylindrical guide unit 320 for coupling the outer guide body 420 of the push button 400 to slide, a semi-circular stopper 330 inserted into the inner circumference of the first cylindrical guide unit 310 to lock the blades 411 and to block descending of the push button 400 such that the liquid in the container is prevented from being pumped, a push button movement space 340 formed in the inner circumference of the first cylindrical guide unit 310 and allowing the up-and-down movement of the blades of the push button by the remaining parts except for the semi-circular stopper 330 and pumping caused by the descending of the push button 400, and a vertical bar type stopper 350 installed at an upper side end of the semi-circular stopper 330 and having a left vertical surface and a right slope to block the clockwise rotation of the push button but to allow the counterclockwise rotation of the push button.

The semi-circular stopper 330 and the push button movement space 340 are sequentially arranged in the first cylindrical guide unit 310 in the symmetric manner such that a pair of the semi-circular stoppers 330 and a pair of push button movement spaces 340 are symmetrically arranged and four blades 411 protrude on the outer circumference of the inner guide body 410 in the radial direction to move the upper ends of the semi-circular stoppers 330 and the push button movement spaces 340 horizontally.

Hereinafter, operations of the cosmetic container will be described.

Since the pumping of the content in the container is carried out by the up-and-down movement when the blades 411 of the push button 400 are disposed in the push button movement spaces 340, the blades 411 formed on the outer circumference of the inner guide body 410 are positioned in the push button movement spaces 340 to press so that the push button 400 descends with the connector tube 220 and the hollow piston 230 and the elastic spring 230 is compressed. Thus, when the content in the pressure chamber 211 is pressed, the content filled up in the pressure chamber 211 of the cylinder 210 is ejected out through the hollow piston 230, the connector tube 220, and the ejection hole 430.

When the push button 400 is released, the push button 400 and the hollow piston 230 gradually ascend due to the restoring force of the elastic spring 240 and the pressure chamber 211 is applied with a vacuum pressure. Then, the ball valve 260 ascends upward due to the atmospheric pressure difference between the pressure chamber 211 and the inside of the container 100 and some of the content in the container 100 is suctioned into the pressure chamber 211. Thus, in this released state, the push button 400 is pressed continuously such that the content in the container 100 may be continuously pumped out.

When the user rotates the push button 400 horizontally after use, the blades 411 of the inner guide body 410 of the push button 400 are positioned on the semi-circular stoppers 330 and a locking state is achieved. In this state, even when the user presses the push button 400, the push button 400 is locked by the semi-circular stopper 330 and does not descend further. As a result, the descending of the push button 400 is not carried out by the semi-circular stoppers 330 and then the content is not ejected.

Meanwhile, the vertical bar type stoppers 350 are installed at the upper side ends of the semi-circular stopper 330. Each of the vertical bar type stoppers 350 is vertical bars installed at the upper side ends of the semi-circular stopper 330 and has a left vertical side and a right slope. The vertical bar type stoppers 350 block the clockwise rotation of the push button 400 with the left vertical side and allow the counterclockwise rotation of the push button 400 to keep going along the right slope.

That is, when the vertical bar type stoppers 350 are installed like in the embodiment, the blades 411 formed on the inner guide body 410 of the push button 400 move on the semi-circular stoppers 330 installed on the inner circumference of the release-preventing and locking device 300 when the push button is rotated clockwise so as to keep the locked state of the push button 400, then the blades 411 come in surface contact with the vertical bar type stoppers 350 to prevent the push button 400 from rotating further, and the blades 411 of the inner guide body 410 are locked by the top of the semi-circular stoppers 330 and the locked state is kept when the push button 400 is pressed.

In this state, when the push button 400 rotates horizontally clockwise, the push button 400 presses the left vertical side of the vertical bar type stopper 350 to prevent the vertical bar type stopper 350 from rotating further and the release-preventing and locking device 300 presses the vertical bar type stopper 350 in the direction of closing the container to prevent the vertical bar type stopper 350 from rotating further even when an additional force is applied.

In order to align the push button 400 with the push button movement space 340 for the up-and-down movement, the blades 411 formed on the inner guide body 410 of the push button 400 move on the semi-circular stoppers 330 of the release-preventing and locking device 300 when the push button 400 rotates horizontally counterclockwise, and then comes in contact with the right slope of the vertical bar type stopper 350 to block the rotation of the push button 400.

However, a forced rotation of the push button 400 along the right slope of the vertical bar type stopper 350 even when further rotation of the push button 400 is allowed, because the release-preventing and locking device 300 is released and separated from the container 100 if the forced rotation is not allowed.

That is, since the release-preventing and locking device 300 has threads, like a usual container locking device, for rotating the push button 400 clockwise to be coupled with the container, the blades 411 come in contact with the vertical bar type stoppers 350 formed in the inner circumference of the release-preventing and locking device 300 and move the vertical bar type stoppers 350 counterclockwise resulting in rotating the release-preventing and locking device 300 in the direction where being separated from the threads of the container 100 and in finally separation of the release-preventing and locking device 300 from the container.

Thus, according to the cosmetic container according to the embodiment of the present invention, the vertical bar type stoppers 350 are formed in the release-preventing and locking device 300 and have the left vertical and perpendicular side and the right slope to prevent the push button 400 from rotating further by the movement of the release-preventing and locking device 300 in the closing direction of the container 100 when the push button 400 rotates clockwise and to allow the blades 411 to move along the right slope of the vertical bar type stoppers 350 to prevent the release-preventing and locking device 300 from being separated from the container even when the push button 400 keeps rotating counterclockwise horizontally.

In addition, the cosmetic container according to an embodiment of the present invention includes a first vertical panel type protrusion 360 with both oblique sides formed in the push button movement space 340 such that the first vertical panel type protrusion 360 temporally blocks the horizontal rotation of the blades 411 when the push button 400 rotates counterclockwise and is disposed at a pumping position.

That is, a user may recognize that the push button 400 is positioned in a pumping space when the push button 400 is positioned in the push button movement space 340 and meets the first vertical panel type protrusion 360 to be blocked firstly, and the push button 400 moves along the first vertical panel type protrusion 360 having both oblique sides while making a sound 'tick' and a user may recognize vibration by his/her palm so that the user does not rotate the push button 400 further but may pump the liquid by moving the push button 400 up and down.

Nevertheless, the push button 400 may be secondly blocked by the vertical bar type stoppers 350 even when the push button 400 does not rotate further, and the release-preventing and locking device 300 may be prevented from being separated from the cosmetic container because the push button 400 rotates along the slope of the vertical bar type stoppers 350 even when the push button 400 is applied with an additional force to rotate further.

The cosmetic container according to an embodiment of the present invention further includes a second vertical panel type protrusion 370 with both oblique sides formed on the semicircular stopper 330, so that a user may recognize that the push button 400 is locked without further rotation of the push button 400 because the push button 400 is moved into the space where the pumping is not carried out and moves along the second vertical panel type protrusion 370 while making a sound 'tick' and a user may recognize vibration by his/her palm without further rotation of the push button 400.

Nevertheless, when the push button 400 keeps rotating further clockwise, the push button 400 meets the vertical bar type stoppers 350 and cannot rotate further due to the meeting with the vertical sides of the vertical bar type stoppers 350.

Meanwhile, the second vertical panel type protrusion 370 may be a vertical bar type with both oblique sides as illustrated in FIG. 8 or tooth type as illustrated in FIG. 9. When the second vertical panel protrusion 370 is the tooth type, the blades 411 of the push button 400 ride thereon and suctioning of remaining liquid is enabled. In the embodiment as illustrated in FIG. 9, the second vertical panel type protrusion is a tooth type but is indicated by a reference numeral **370*a*** to distinguish.

That is, when the second vertical panel type protrusion **370*a* has a tooth shape with both swollen sides and a concave center, the blades 411 of the push button 400 ride on the second vertical panel type protrusion 370*a* to make a vacuum pressure in the cylinder 210 of the pumping unit while the vacuum pressure is applied to the ejection hole 430 of the push button 400 so that the remaining liquid at the entrance of the push button 400** is suctioned into the cosmetic container.

Therefore, the liquid remaining at the entrance of the push button 400 is suctioned and the entrance of the push button 400 can be prevented from being contaminated.

As described above, the suctioning operation of the ejection hole 430 of the push button 400 is caused by slightly lifting the hollow piston 230 and the vacuum pressure in the cylinder 210. Since the vacuum pressure is very weak, the ball valve 260 is not lifter up but the vacuum pressure is applied into the hollow piston 230, the connector tube, and a discharging tube of the push button 400 to suction the liquid remained therein slightly.

Therefore, the liquid remained in the entrance of the push button 400 is slightly suctioned and as a result the remaining liquid in the entrance is not exposed directly to the outside of the cosmetic container.

What is claimed is:

1. A cosmetic container having a release-preventing device comprising:

a cylinder formed with a pressure chamber where content in a cosmetic container is suctioned and temporally accommodated;

a connector tube stuck to the inner wall of the cylinder;

a hollow piston coupled with the lower end of the connector tube to support the connector tube;

a release-preventing and locking device having a lower end to be inserted into the cylinder and allowing a screw-coupling of an upper outer side of the cosmetic container; and a push button coupled with a top of the release-preventing and locking device and pumping the hollow piston while up-and-down movements pump the content in the cosmetic container out through an ejection hole, having an inner guide body and an outer guide body parts coupled with the release-preventing and locking device, and a plurality of blades formed on the push button on the outer circumference of the inner guide body to determine up-and-down movements of the inner guide body;

wherein the release-preventing and locking device includes:

a first cylindrical guide unit allowing the inner guide body of the push button to slide;

a second cylindrical guide unit allowing the outer guide body of the push button to slide;

a semi-circular stopper inserted into the inner circumference of the first cylindrical guide unit to lock the blades and to block descending of the push button to prevent a liquid in the cosmetic container from being pumped out;

a push button movement space formed on the first cylindrical guide unit and allowing an up-and-down movements of the blades of the push button with the parts except for the semi-circular stopper such that pumping caused by the descending of the push button is enabled; and a vertically lengthwise protrusion installed at the top side end of the stopper and having a vertical end of a left side and a sloped end of a right side to block a clockwise rotation of the push button and to allow a counterclockwise rotation of the push button.

2. The cosmetic container of claim 1, wherein the first cylindrical guide unit comprises a first bump protrusion installed at a side of the push button movement space and temporally blocking a horizontal rotation of the push button when the push button rotated to be positioned at a pumping position.

3. The cosmetic container of claim 2, wherein the first bump protrusion has both oblique sides.

4. The cosmetic container claim 2, wherein the first cylindrical guide unit comprises a second bump protrusion installed on the semi-circular stopper, positioned at a left side of the vertically lengthwise protrusion, and temporally blocking a horizontal rotation of the blades of the push button when the push button rotates clockwise and is positioned at a position where pumping is not carried out.

5. The cosmetic container of claim 4, wherein second bump protrusion has both oblique sides.

6. The cosmetic container of claim 4, wherein the second bump protrusion has a tooth shape with both swollen sides and a concave center such that the blades of the push button ride thereon and suctioning of the remaining liquid is enabled.

* * * * *